US011523689B2

(12) United States Patent
Jensen

(10) Patent No.: US 11,523,689 B2
(45) Date of Patent: Dec. 13, 2022

(54) CUSHION

(71) Applicant: Gemma Jensen, Cheshire (GB)

(72) Inventor: Gemma Jensen, Cheshire (GB)

( * ) Notice: Subject to any disclaimer, the term of this patent is extended or adjusted under 35 U.S.C. 154(b) by 0 days.

(21) Appl. No.: 17/119,926

(22) Filed: Dec. 11, 2020

(65) Prior Publication Data

US 2021/0093094 A1 Apr. 1, 2021

Related U.S. Application Data

(63) Continuation of application No. 16/425,785, filed on May 29, 2019, now Pat. No. 10,881,213.

(30) Foreign Application Priority Data

May 23, 2019 (EP) ..... 19176195

(51) Int. Cl.
*A47C 16/00* (2006.01)
*A47G 9/10* (2006.01)

(52) U.S. Cl.
CPC ..... *A47C 16/00* (2013.01); *A47G 9/1045* (2013.01); *A47G 9/1081* (2013.01); *A47G 9/1027* (2013.01); *A47G 2009/1018* (2013.01)

(58) Field of Classification Search
CPC ..... A47C 16/00; A47C 7/383; A47C 27/086; A47G 9/1045; A47G 9/1081; A47G 9/1027; A47G 9/1036; A47G 9/1063; A47G 9/1072; A47G 9/109; A47G 9/1054; A47G 2009/1018; B60N 2/4879
USPC ..... 297/393
See application file for complete search history.

(56) References Cited

U.S. PATENT DOCUMENTS

| | | | | |
|---|---|---|---|---|
| 5,064,245 | A * | 11/1991 | Stephens | B60N 2/2833 297/397 |
| 7,793,371 | B1 * | 9/2010 | Leach | A47C 20/025 5/632 |
| 8,136,186 | B1 * | 3/2012 | Leach | A47C 27/086 5/631 |
| 8,707,485 | B1 * | 4/2014 | Conley | A47G 9/109 5/636 |
| 9,808,100 | B2 * | 11/2017 | Jensen | A47G 9/1081 |
| 2008/0189863 | A1 * | 8/2008 | Zappas | A47G 9/10 5/636 |
| 2009/0133192 | A1 * | 5/2009 | Hassell | A47C 7/383 5/639 |
| 2012/0011655 | A1 * | 1/2012 | Rojas | A47C 7/383 5/636 |

(Continued)

FOREIGN PATENT DOCUMENTS

WO 03/001951 A1 1/2003

*Primary Examiner* — Mark R Wendell
(74) *Attorney, Agent, or Firm* — Craft Chu PLLC; Andrew W. Chu

(57) ABSTRACT

A cushion includes a pillow portion, an elongate trunk portion and a scarf. The pillow portion has a front side and a rear side and defines a support surface on the front side which is useable for supporting the head of a user of the cushion. The trunk portion extends away from the pillow portion and has a terminal end which is distal to the pillow portion. The scarf is attached to the pillow portion and/or the trunk portion at a first end portion of the scarf and is engageable, in use, with the trunk portion at a portion of the scarf that is spaced from the first end portion.

13 Claims, 15 Drawing Sheets

(56) References Cited

U.S. PATENT DOCUMENTS

| | | | | |
|---|---|---|---|---|
| 2013/0312192 | A1* | 11/2013 | Lee | A47G 9/007 5/639 |
| 2015/0026891 | A1* | 1/2015 | Davis | A47G 9/1081 5/636 |
| 2015/0274044 | A1* | 10/2015 | Kreppein | A47G 9/1081 5/636 |
| 2015/0352988 | A1* | 12/2015 | Knapp | B60N 2/80 297/393 |
| 2016/0345760 | A1* | 12/2016 | Pesale | A47G 9/109 |
| 2017/0208881 | A1* | 7/2017 | Leathers | A41D 23/00 |
| 2018/0055252 | A1* | 3/2018 | Jensen | A47G 9/1081 |
| 2018/0055253 | A1* | 3/2018 | Jensen | A47C 7/383 |
| 2019/0254356 | A1* | 8/2019 | Clores | A47G 9/1045 |

* cited by examiner

CUSHION

CROSS-REFERENCE TO RELATED APPLICATIONS

The present application claims priority under 35 U.S.C. Section 120 from U.S. patent application Ser. No. 16/425,785, filed on 29 May 2019, entitled "CUSHION". See also Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present disclosure relates to cushions, particularly though not exclusively to portable travel pillows such as those for supporting the resting head of a traveller sat in a generally upright vehicle seat during a journey.

2. Description of Related Art Including Information Disclosed Under 37 CFR 1.97 and 37 CFR 1.98

Cushions for use in supporting the resting head of a seated person are often referred to as travel pillows, even though they are not limited in their use by people in the act of travelling. Many differing designs of travel pillows exist and each aims to comfortably support the user's head in a position that can be maintained without strain or effort by the user. This has proven to be a difficult problem to solve effectively.

Though many cushion designs may provide comfort when ideally positioned about the person of the user, it is not uncommon that the shaping of the cushion is not conducive to maintaining that ideal position without some effort by the user. A common problem is the slipping of a cushion from the shoulder of a user where, ideally, the cushion should remain if it is to support the resting head of a user effectively. Users typically resort to attempting to hold the cushion in place by hand or by urging a shoulder upwardly to sandwich the cushion between head and shoulder. This inevitably brings discomfort.

Other designs may provide means for retaining a cushion in the intended position about a user. These can involve structures and shapes added to, or formed by, the cushion which reduce its versatility and/or ease of comfortable use. For example, complex and elaborate shapes designed to keep a cushion in place often limit the range of positions a user can place the cushion about their person in use.

BRIEF SUMMARY OF THE INVENTION

The present invention desirably aims to provide a secure, versatile and comfortable cushion for supporting the resting head of a user in a generally upright seat or the like.

At its most general, the present invention provides a cushion for supporting the head of a person, the cushion including a first portion that is useable to provide support for the back of the head or neck of the person and/or the side of the head of the person, a second portion that extends from the first portion and which is usable to provide support for the chin of the person, and a scarf which may be selectively wrapped around a user's neck to aid in maintaining the cushion in the place during use.

According to the present invention in a first aspect, there is provided a cushion including: a pillow portion, an elongate trunk portion and a scarf; the pillow portion having a front side and a rear side, and defining a support surface on the front side which is useable for supporting the head of a user of the cushion; the trunk portion extending away from the pillow portion and having a terminal end which is distal to the pillow portion, wherein the scarf is attached to the pillow portion and/or the trunk portion at a first end portion of the scarf and is engageable, in use, with the trunk portion at a portion of the scarf that is spaced from the first end portion.

The scarf preferably extends from the rear side of the pillow portion and/or the rear side of the trunk portion.

The scarf may be attached to the pillow portion and/or the trunk portion at a point corresponding to a substantial midpoint of the pillow portion in a direction of a longitudinal axis of the pillow portion. This may be a point lying on a plane bisecting the pillow portion. Such a plane may contain the trunk portion.

The scarf is preferably attached to the pillow portion and/or the trunk portion along a line of attachment that extends in a direction generally transverse to a direction of a longitudinal axis of the pillow portion. The line of attachment may extend substantially parallel to the extension direction of the trunk portion away from the pillow portion.

Such a line of attachment (particularly, although not exclusively, in combination with attachment at a midpoint and/or substantially parallel to the extension direction of the trunk portion away from the pillow portion, as discussed above) has a number of benefits. The line of attachment enables the scarf to be pulled to the right or left side of a user with ease when the pillow portion is switched to the other side. Also, this line of attachment allows the scarf to be moved independently from the pillow portion, i.e. the scarf can be pulled and maneuvered in all directions without it influencing the position of the pillow portion. This means that the user can position the pillow portion at the side of the head and then adjust the scarf until they find a comfortable position. Even though the scarf is attached to the pillow portion it, effectively, remains a separate entity from a use perspective. When the scarf is used on the opposite side, the cushion does not have to be rotated for the scarf to be used. Because the scarf can be used in exactly the same way on both sides, it also means that the 'experience' of the scarf is the same for both sides.

The scarf may be substantially rectangular, triangular, of tapered form, or otherwise. It may be attached to the pillow portion and/or the trunk portion along an edge of the scarf. When rectangular, for example, it may be attached along a short edge. When tapered, for example, the scarf may be attached to the pillow portion and/or the trunk portion at its wider or narrower end.

The length of the attachment edge and the width of the scarf may be varied, as will be readily appreciated by those skilled in the art. The length of the attachment edge may be between 4 and 26 cm, 5 and 20 cm, or 10 and 20 cm. It may be any width between 4 and 26 cm. In a particularly preferred arrangement it is 16 cm. The length of the attachment edge may substantially equal to a width of the pillow portion in a direction generally transverse to a direction of a longitudinal axis of the pillow portion. It may otherwise be longer or shorter. If shorter then the scarf may be attached further down the pillow portion (in a direction towards the trunk portion), as this will aid in generating more support.

An attachment means is preferably provided for removably attaching the scarf to the trunk at a portion of the scarf that is spaced from the first end portion of the scarf. The attachment means may comprise one or more openings in the scarf adapted to receive the trunk therethrough for hooking the scarf on the trunk. A plurality of the openings may be provided in the scarf, the openings being spaced from one another along a length of the scarf. Such a plurality of openings allows for adjustability.

The scarf is preferably stretchable. It may alternatively be non-stretchable.

The scarf can be made from fleece or a breathable fabric, such as bamboo.

The scarf may be permanently or removably attached to the pillow portion and/or the trunk portion.

The cushion may comprises a pocket for stowage of the scarf when it is not in use. This is particularly preferable when the scarf is permanently attached. A user may choose to deploy the scarf or not.

With a detachable scarf, there may be a first loop or hole provided at the first end portion of the scarf for receiving the trunk therethrough for attaching the scarf to an end portion of the trunk which is proximal the pillow portion.

The scarf may further be provided with a second loop, hole or snap-loop fastener at the first end portion of the scarf for attachment to a fixing means on the pillow portion which may comprise a loop, a button or a clip. In alternatives, the loop, hole or snap-loop may be provided on the pillow portion with the fixing means provided on the scarf.

The scarf may be provided with a spine in its first end portion. This is particularly preferred for detachable scarfs to provide integrity to the scarf at its fixed end. The provision or omission of a spine may be dependent on a number of factors including, but not limited to, the thickness of the scarf. Thicker/stronger materials will not need a spine whereas thinner/weaker materials may.

The scarf may be wider than the pillow portion in a direction generally transverse to a direction of a longitudinal axis of the pillow portion. It may otherwise have the same width or be narrower. If a narrower width scarf is used then the end of the scarf may be attached further down (in a direction towards the trunk portion), as this will aid in generating more support.

The width of the pillow portion (a longitudinal dimension of the pillow portion) is preferably wider than the trunk portion. The pillow portion may have a width of at least 10 cm, it is preferably between 20 and 35 cm.

The pillow portion may be generally concave in shape.

The pillow portion preferably projects from the trunk portion transversely to the elongation of the trunk portion.

The trunk portion is preferably configured so that it is usable to contact the underside of the chin of a user whose head is being supported by the pillow portion.

The pillow portion may project from the trunk portion transversely to the elongation of the trunk portion from two opposite sides of the trunk portion. The cushion may be substantially symmetrical, so that the pillow portion is usable to support the head of a user from either side of the head of the user. The cushion may be substantially symmetrical about a plane bisecting the pillow portion and containing the trunk portion.

There may be a single trunk portion. The trunk portion may have a substantially constant cross-section through its length or may taper towards its end. In some arrangements it may have a forked second end portion.

There may alternatively be multiple trunk portions provided. Where the cushion is substantially symmetrical and two trunks are provided, the cushion may be substantially symmetrical about a plane bisecting the pillow portion and lying between the two trunk portions. The two trunk portions may extend from the pillow portion at an oblique angle to one another.

The trunk portion preferably emerges from the rear side of the pillow portion. It may emerge as a spine extending across the rear side of the pillow portion. In such case the scarf may be attached to the spine.

The trunk portion may be formed so that its rest shape is curved or bent.

The trunk portion may have a rest shape that has a frontwardly hooked configuration such that said terminal end is located frontwardly of said pillow portion.

The trunk may be configured such that it hooks acutely upwards. In such an arrangement, the terminal end of the trunk portion may be positioned above a bottom edge of the pillow portion.

The trunk portion may be resiliently compliant. In such case, the trunk portion may be manipulated to form a trunk that is bent or curved as desired.

The cushion may be filled with a soft or compliant material, which may comprise foam, fibrous stuffing material, or otherwise. The cushion may otherwise be inflatable.

The scarf may be attached, permanently or detachably, to a cover, i.e. pillow case, which is sized and shaped for receiving a cushion having a pillow portion and a trunk portion.

BRIEF DESCRIPTION OF THE SEVERAL VIEWS OF THE DRAWINGS

Non-limiting embodiments of the present invention will now be described, by way of example only, with reference to the accompanying drawings.

DETAILED DESCRIPTION OF THE INVENTION

Figure 1:
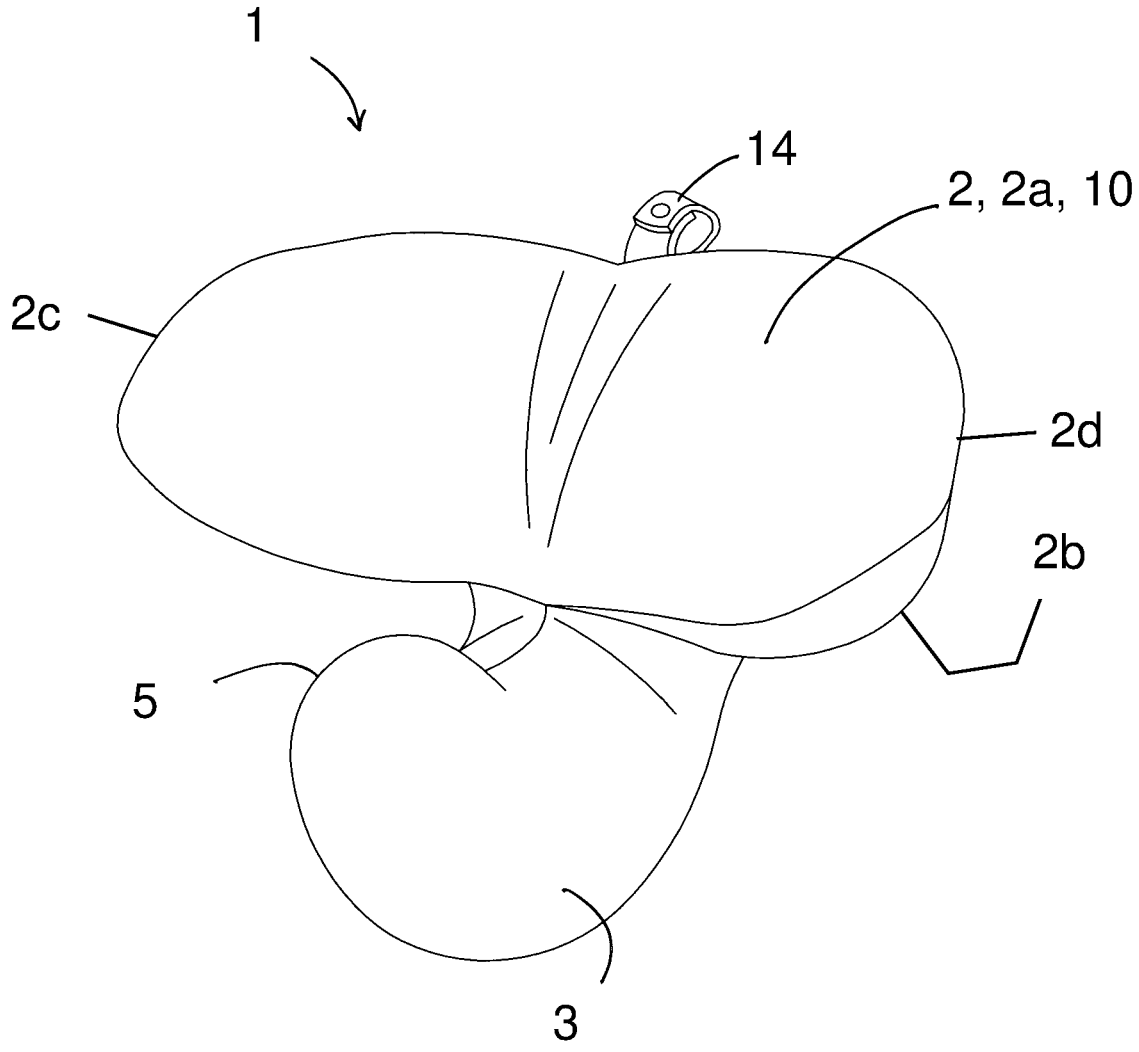
FIG. 1 is a front perspective view of a cushion according to a first embodiment of the present invention (the scarf is not visible).

With reference to the figures, embodiments of the present invention will now be discussed.

In accordance with all depicted arrangements, there is provided a cushion 1 including a pillow portion 2, an elongate trunk portion 3 and a scarf 4. The pillow portion 2 has a front side 2*a*, a rear side 2*b* opposite the front side, a first lateral side 2*c*, and a second lateral side 2*d* opposite the first lateral side, and defines a support surface 10 on the front side 2*a* which is useable for supporting the head of a user of the cushion 1. The trunk portion 3 extends away from the pillow portion 2 and has a terminal end 5 which is distal to the pillow portion 2. The scarf 4, having a first scarf side 4*a* and a second scarf side 4*b* opposite the first scarf side, is attached to the pillow portion and/or the trunk portion at a first end 7 of the scarf 4 and is engageable, in use, with the trunk portion 3 at a portion of the scarf 4 that is spaced from the first end 7.

The head support surface 10, defined by the front side 2*a* of the pillow portion, is adapted and arranged for supporting a resting head of a user in a generally upright seat. The elongated trunk portion 3 is adapted and arranged for contacting the underside of the chin of the user whilst their head is being supported by the pillow portion 2. The scarf 4 is adapted and arranged for wrapping around the neck of the user, whilst their head is being supported by the pillow portion 2 and the trunk 3 is contacting the underside of their chin, for holding the cushion in place during its use.

Figure 2:
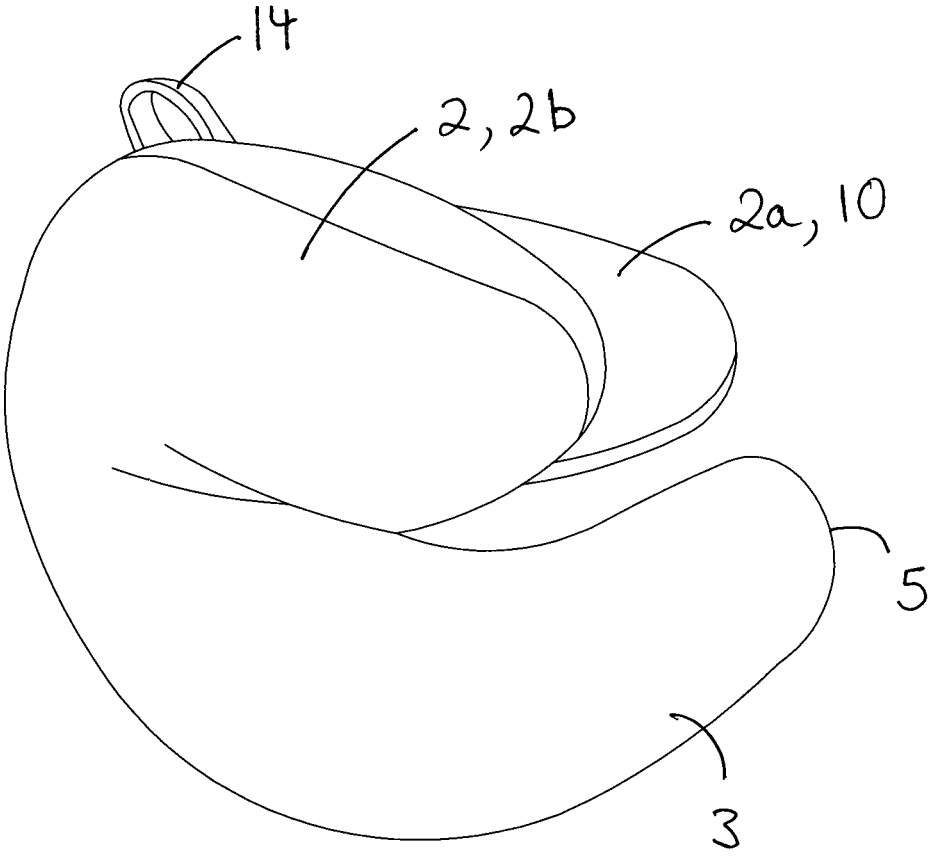
FIG. 2 is a side perspective view of the cushion of FIG. 1.

The trunk portion 3 preferably defines a resiliently compliant bend, as shown, which extends from the pillow portion 2 to render the trunk generally hooked in shape at least towards a free end (or terminal end 5) thereof, which is distal from the pillow portion 2. The trunk portion 3 may have a rest shape that has a frontwardly hooked configuration such that said terminal end 5 is located frontwardly of said pillow portion 2, as seen best seen in FIG. 2.

The pillow portion 2 preferably projects from the trunk portion 3 such that the head support surface 10 extends in a direction generally transverse to the elongation of the trunk portion. The elongation of the trunk portion is preferably directed to follow a bend (i.e. to hook) in a direction generally transverse to the direction in which the head support surface extends to position the terminal end 5 of the trunk portion 3 adjacent to the head support surface 10. The degree to which the trunk bends may be varied. In some arrangements the trunk portion may extend substantially straight along all, a minority or a majority of its length.

The pillow portion 2 is preferably shaped to define a pillow structure comprising on one side (shown in FIG. 1) the head support panel 10 bounded by peripheral pillow edges. In the present arrangement, these edges define a substantially semi-circular (e.g. "D"-shaped) boundary. The pillow portion could of course be alternatively shaped, such as but not limited to rectangular, triangular or oval shaped, with the pillow edges defining an appropriately shaped boundary. The pillow is preferably formed such that the head support panel 10 is concave, and the pillow portion 2 is generally concave in shape, as shown. In alternative arrangements it could be flat or otherwise shaped.

The trunk portion 3 defines an elongated cushion extending from the pillow portion 2. It may be substantially continuously curved. It could take alternative forms, including an angular form, a form comprising one or more substantially straight portions, or otherwise. It is preferably integrally formed with the pillow portion 2 to extend from a rear side 2*b* of the pillow portion 2 reverse to the side 2*b* defining the head support panel 10. The trunk portion 3 if substantially continuously curved may be substantially crescent-shaped.

The trunk portion 3 may emerge from the rear side of the pillow portion as a spine or ridge. The trunk portion 3 may present a ridge or spine which bisects the rear surface 2*a* of the pillow portion 2. This adds strength to the cushion and renders the relative positioning and orientation of the pillow part and the hooked trunk part more robust and resilient—i.e. far less prone to sagging, deformation or floppiness of the pillow portion 2 relative to the trunk portion 3. It should be noted, however, that the trunk portion 3 may otherwise extend from the pillow portion 2. For example, rather than extending from the rear side 2*b* of the pillow portion 2 it could extend from a side edge of the pillow portion, or otherwise, in particular a bottom edge (in use, as seen in FIGS. 5 to 8).

The pillow portion 2 is preferably wider than the trunk portion 3, as clearly shown. The pillow portion 2 preferably projects from the trunk portion 3 transversely to the elongation of the trunk portion 2 from two opposite sides of the trunk portion 3, as clearly shown. The cushion may be substantially symmetrical, so that the pillow portion 2 is usable to support the head of a user from either side of the head of the user. The cushion is most preferably substantially symmetrical about a plane bisecting the pillow portion 2 and containing the trunk portion 3, as again shown. The trunk portion 3 is preferably formed so that its rest shape is curved or bent.

It may alternatively be resiliently compliant. In such case, the trunk portion may be manipulated to form a trunk that is bent or curved as desired.

There may be a single trunk portion 3, as shown. There may alternatively be multiple trunk portions provided. The trunk portion(s) 3 in any arrangement may have a forked second end portion, or otherwise. In any configuration the trunk portion(s) may have an acutely hooked terminal end 5.

FIGS. 5 to 8 illustrate the support position of the cushion lodged over the shoulder of a user, wherein the head support panel 2*a* of the cushion portion 2 supports a side of a user's head and the hooked trunk portion 3 hooks under the head to support the chin of the user concurrently. The scarf 4 is shown to extend from the rear face 2*b* of the pillow portion (as is preferred), wrap around the neck of the user and engage the trunk portion 3 at a portion of the scarf 4 that is spaced from the first end portion of the scarf 4. As discussed, the scarf 4 aids in maintaining the cushion in place during use. The scarf 4 is shown attached to the trunk portion 3 in FIGS. 5 and 7 and is tucked between the trunk portion 3 and the user's body in FIG. 8, as a possible alternative. The scarf could also be tucked above the trunk and wedged underneath the chin, or wrapped around the end of the trunk.

Figure 5:
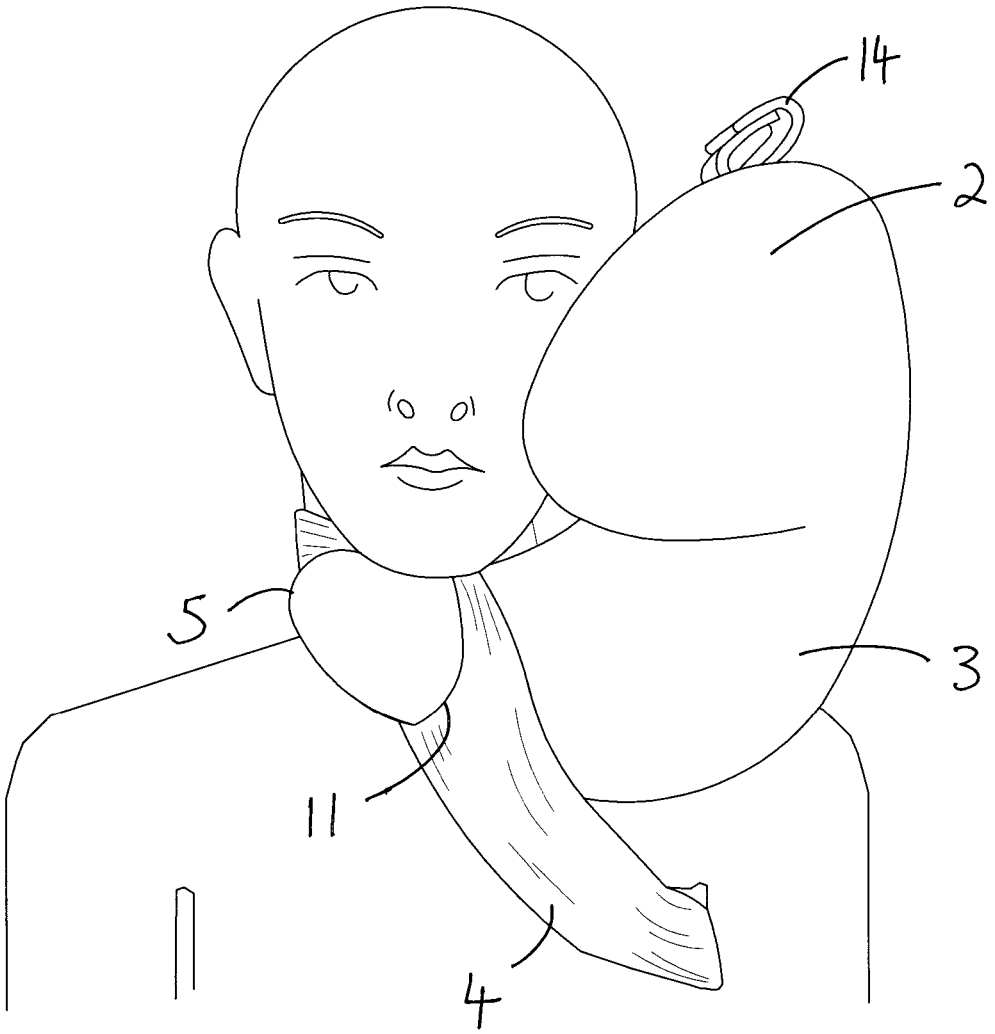
FIG. 5 is front elevation view of a user of the cushion of FIGS. 1 to 4, showing the cushion in use.
Figure 6:
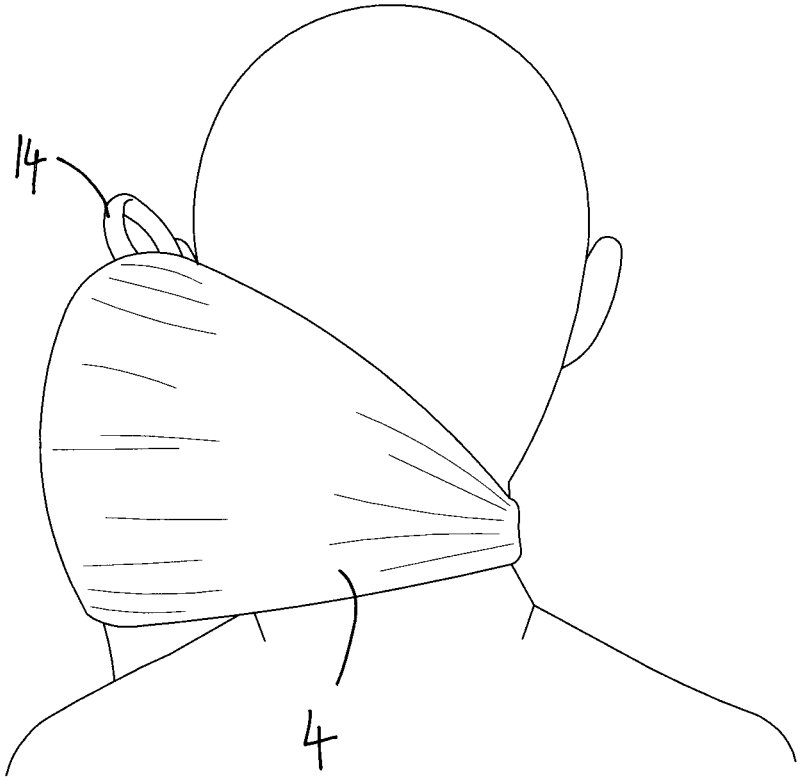
FIG. 6 is a rear elevation view of a user of the cushion of FIGS. 1 to 4, showing the cushion in use.
Figure 8:
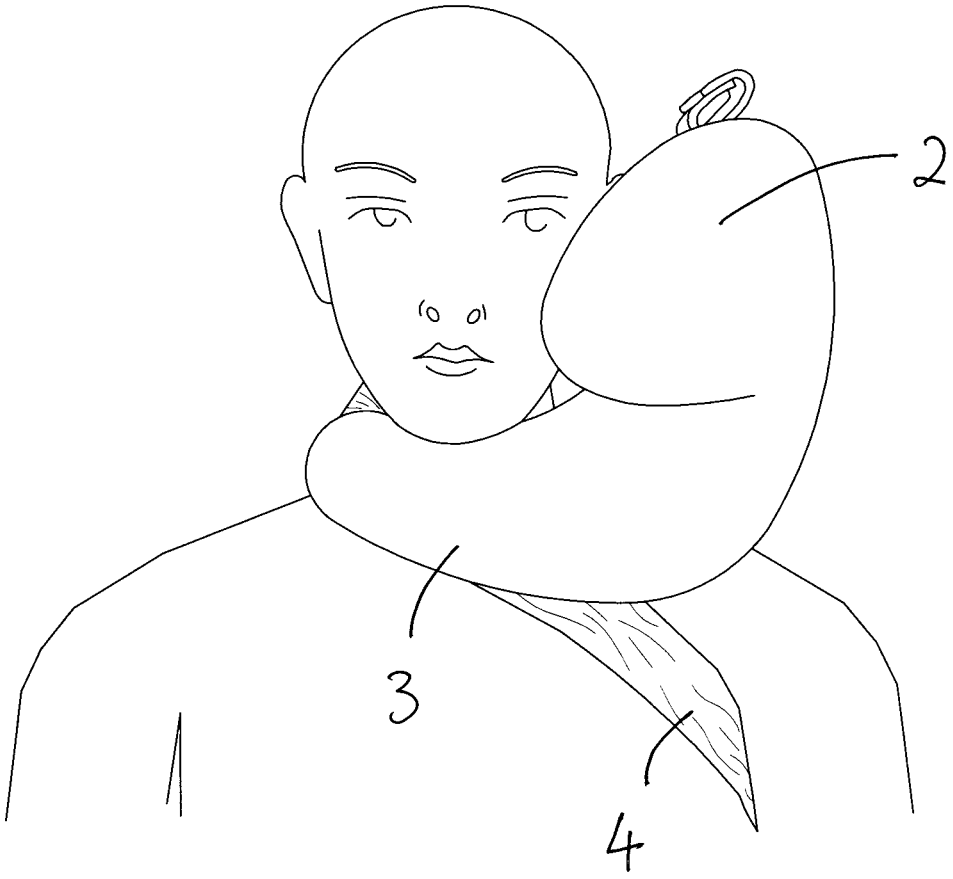
FIG. 8 is a front elevation view of the user of the cushion of FIGS. 1 to 4, showing the cushion in use with the scarf portion tucked between the user's body and the trunk portion (rather than attached to the trunk portion as in FIGS. 4, 5 and 7).

As shown in FIGS. 5 and 8, in this use of the cushion 1 the trunk portion 3 extends across the underside of the chin of the user of the cushion, to a point beyond the mid-point of the chin of the user, as is preferred. The trunk portion 3 provides support for substantially the whole of the underside of the chin of the user.

Figure 7:
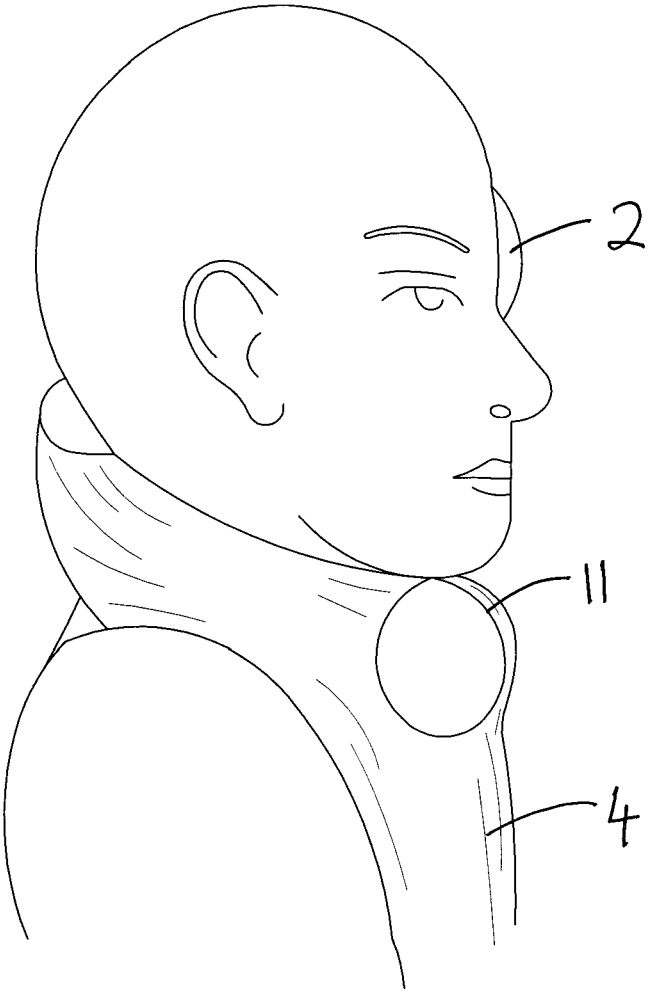
FIG. 7 is a side elevation view of a user of the cushion of FIGS. 1 to 4, showing the cushion in use.

As shown in FIG. 7, in this use of the cushion, as again is preferred, the pillow portion 2 extends across substantially the whole of the side of the head of the user of the cushion 1, i.e. the pillow portion 2 extends from substantially the back of the head of the user to substantially the front of the head of the user, e.g. to a position just beyond the front of the face of the user. The ear of the user is completely covered by the pillow portion 2.

Whilst the cushion will generally be filled with a soft or compliant material, which may comprise foam, fibrous stuffing material, or otherwise, arrangements are possible that are inflatable.

Moreover, the scarf may be attached, in accordance with any of the attachment means discussed herein to a cover, i.e. pillow case that is sized and shaped for receiving a cushion having a pillow portion and a trunk portion.

The scarf 4 will now be considered is more detail.

As discussed, the scarf 4 preferably extends from the rear side 2*b* of the pillow portion 2. In the arrangements shown, the scarf has a greater width than the pillow portion 2. In alternative arrangements, this need not be the case and it could be narrower. The scarf 3 is also shown to be attached to both the pillow portion 2 and the trunk 3. This again need not be the case. The scarf may be attached to either the pillow portion 2 or the trunk portion 3 as alternatives. Particularly, when the scarf is narrower than the pillow portion, it may be attached to the pillow portion only, for example.

Regardless of its size or specific attachment, i.e. to the pillow portion 2 and/or the trunk portion 3, it is preferable that the scarf 4 is attached at a point corresponding to a substantial midpoint of the pillow portion 2 in a direction of a longitudinal axis of the pillow portion. When the cushion 1 is symmetrical with a single trunk portion 3, as shown, the scarf 4 may be attached so as to be coincident with a plane bisecting the pillow portion 2 and containing the trunk portion 3. It should be appreciated that in alternative arrangements, including, for example, non-symmetrical arrangements or otherwise, the scarf 4 may be otherwise attached. For example, it could be attached adjacent a transverse edge of the pillow portion 2 or otherwise.

The scarf 4 is shown in all depicted arrangements to be attached along a line of attachment that extends in a direction generally transverse to a direction of a longitudinal axis of the pillow portion 2, as is preferred. It is to be noted, however, that it need not be so attached. The attachment may depend in part on the means of attachment of the scarf 4 and/or on the specific shape of the scarf 4. In the depicted arrangements, the scarf 4 is substantially rectangular and is attached along a short edge of the scarf 4. Alternative scarf shapes may find application and the present application is not to be limited to any specific shape of scarf 4.

As mentioned with respect to FIGS. 5 and 8, the scarf 4 may be arranged to engage the trunk portion 3 at a portion of the scarf 4 that is spaced from the first end portion such that it is attached to the trunk 3 or simply contacts the trunk 3 and is tucked/sandwiched between the trunk portion 3 and the user's body (chest). It could alternatively be tucked between the trunk and the user's chin, or the scarf could be just pulled across the trunk or wrapped round the trunk. The scarf 4 may be arranged to engage the trunk portion 3 at a second end portion of the scarf 4. In the case of tucking/sandwiching, the force applied to the trunk portion 3 by the user's chin is generally sufficient to hold the scarf 4 for it to have the effect of aiding in maintaining the cushion 1 in place during use. It is preferable, however, that an attachment means of some form is provided for removably attaching/fixing the scarf 4 to the trunk portion 3 at a portion of the scarf 4 that is spaced from the first end portion of the scarf 4.

Figure 12:
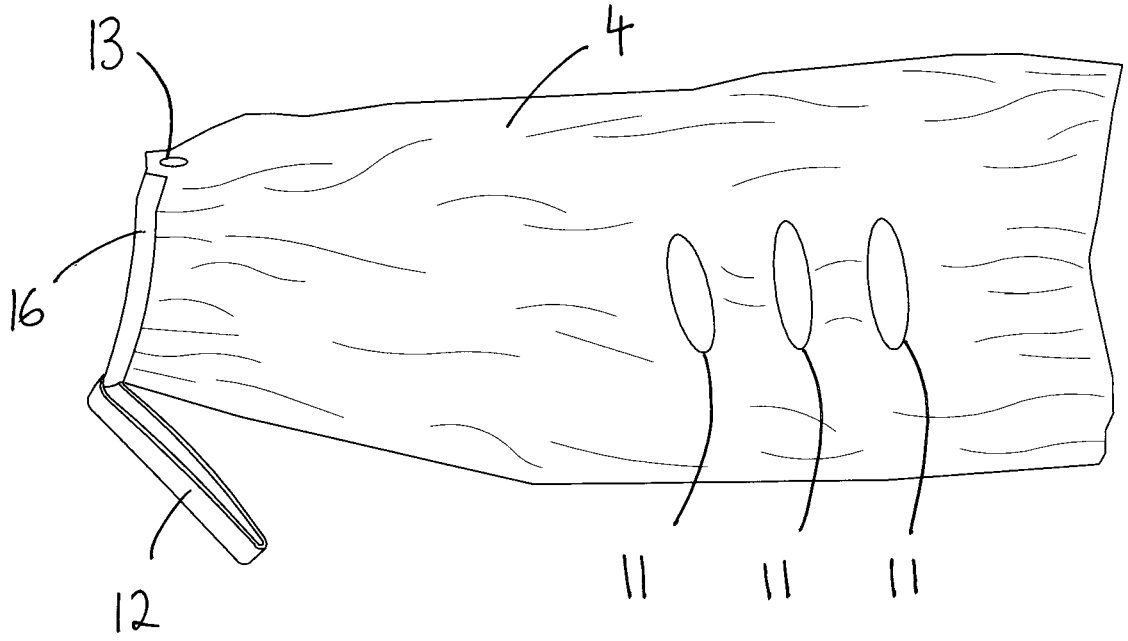
FIG. 12 is a perspective view of a detachable scarf.

A particularly preferred but non-limiting attachment means is shown in FIGS. 4, 5, 7 and 12. The scarf is provided with a plurality of openings 11 in the scarf 4 that are adapted to receive the trunk portion 3 therethrough for hooking the scarf 4 on the trunk portion 3. The provision of a plurality of openings 11 is preferred to provide for adjustability, and maintaining the tension of the scarf, which helps keep the pillow from slipping, however, alternative arrangements could be provided with a single opening 11 only. The plurality of openings 11 are spaced from one another along a length of the scarf 4, as best seen in FIG. 12. As will be appreciated by those skilled in the art, numerous alternative attachment means could be provided including but not limited to hook and loop fasteners, buttons, poppers, clips or otherwise.

As will be appreciated, whilst all arrangements are stated to include attachment means (in the exemplary form of openings 11), attachment means may be omitted from any of the depicted arrangements.

The scarf 4 is preferably stretchable to aid in its function. It preferably comprises a soft fabric for comfort purposes. It need not be stretchable, however. It may be fleece with no stretch to look and feel more like a traditional scarf, and it could also be bamboo fabric.

The scarf may be permanently or removably attached. FIG. 3, FIGS. 9 and 10, FIG. 11 and FIG. 12 show four different arrangements.

Figure 3:
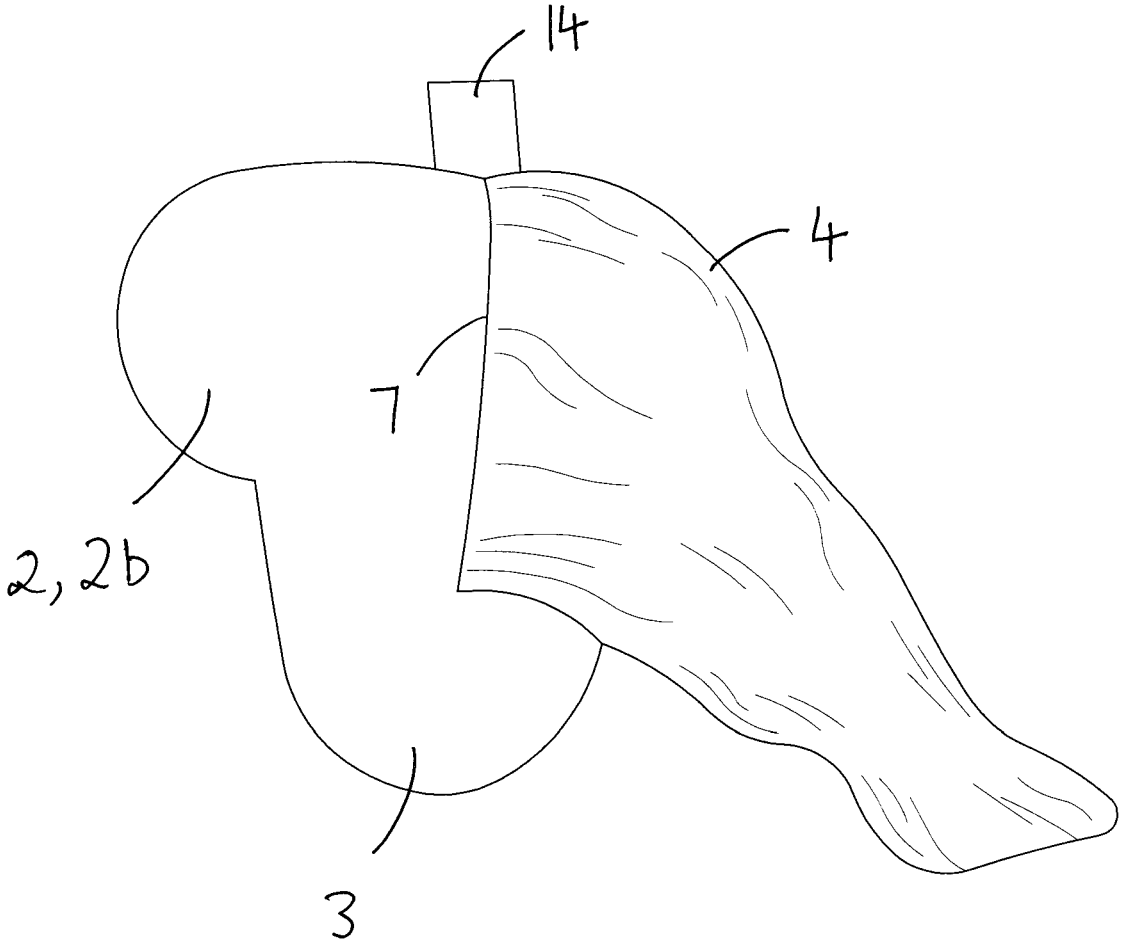
FIG. 3 is a rear elevation view of the cushion of FIGS. 1 and 2 showing the scarf and the attachment arrangement of the scarf to the pillow and trunk portions.
Figure 4:
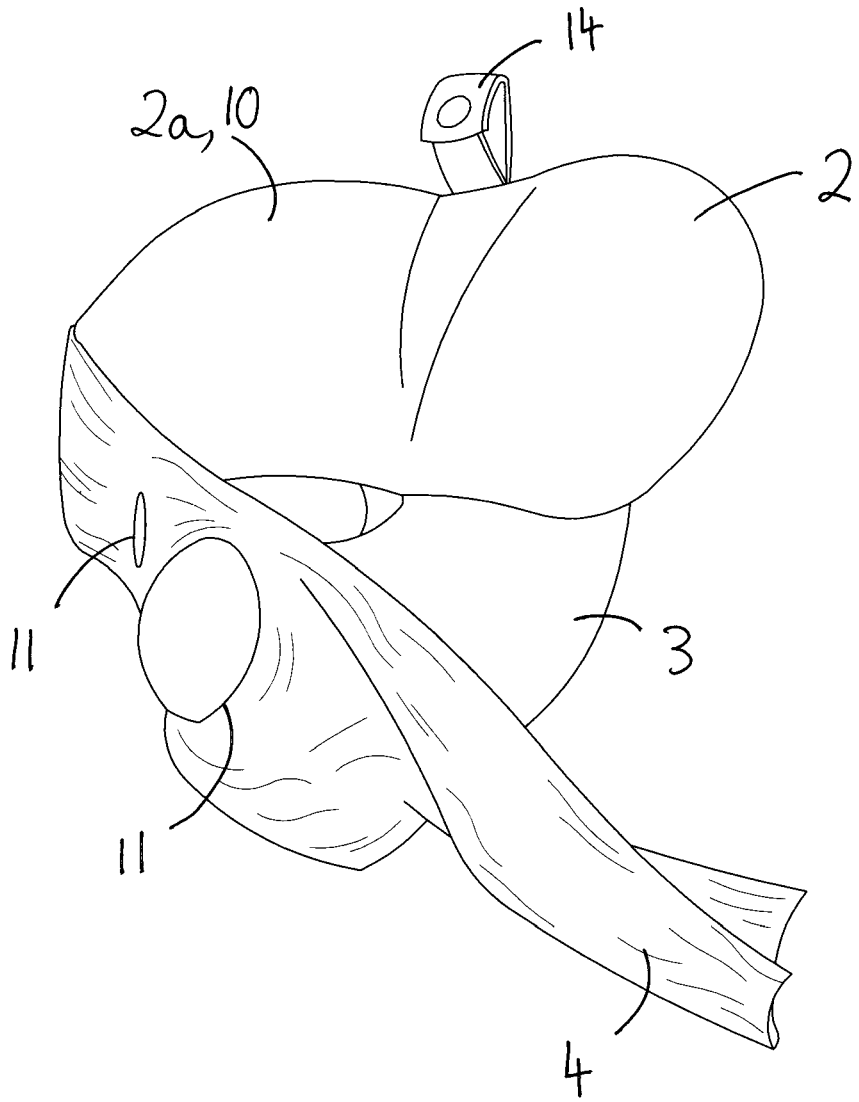
FIG. 4 is a front perspective view of the cushion of FIGS. 1 to 3 with the scarf shown attached to the trunk portion.

FIG. 3 shows a permanent attachment of the scarf 4. The scarf 4 is fixed along an attachment line by stitching. It may be stitched into a seam of the cushion 1. It could be otherwise attached such as by use of adhesive.

Figure 9:
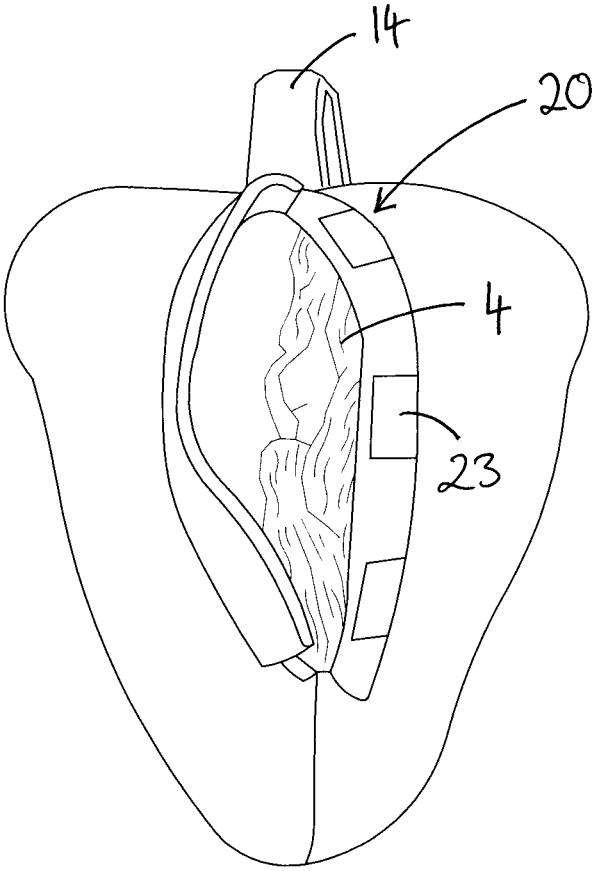
FIG. 9 is a rear perspective view of a cushion according to a second embodiment, which comprises an alternative attachment arrangement of the scarf to the pillow and trunk portions, which comprises an internal pocket—the scarf is shown stowed whilst the pocket is opened.
Figure 10:
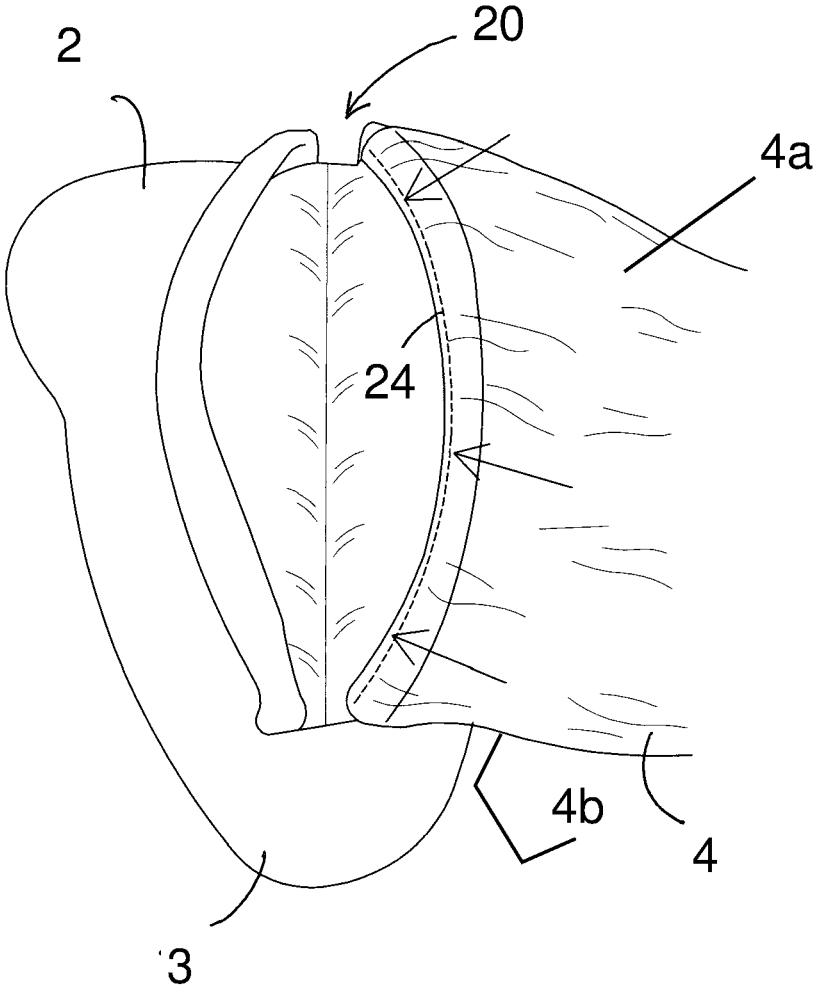
FIG. 10 is a rear perspective view of the cushion of FIG. 9 with the scarf deployed.
Figure 11:
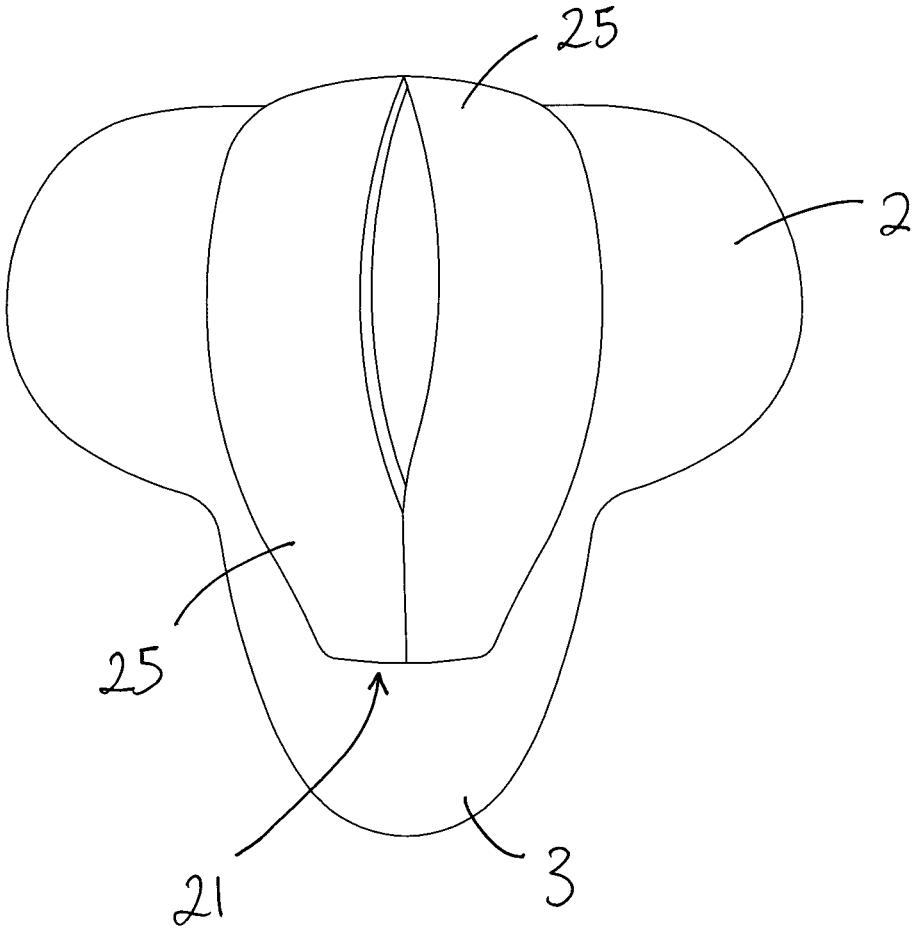
FIG. 11 is a rear perspective view of a cushion according to a third embodiment, which comprises an alternative attachment arrangement of the scarf to the pillow and trunk portions, which comprises an external pocket.

FIGS. 9 and 10 and FIG. 11 show the use of pockets for stowage of the scarf 4 when it is not in use. The pocket 20 in FIGS. 9 and 10 is internal and the pocket 21 in FIG. 11 is external. Whilst the scarf is permanently attached in these arrangements, with the scarf fixed inside the pockets, such pockets could alternatively store a detachable scarf, such as that shown in FIGS. 12 to 14 and discussed below, or otherwise.

With reference to FIGS. 9 and 10, the internal pocket 20 is formed in any conventional manner and comprises closure elements 23 for closing the pocket when the scarf is not in use. The closure elements 23 in the present arrangement are hook and loop fasteners but could comprise any suitable alternative, including poppers, buttons, etc. The pocket opening extends in a direction generally transverse to a direction of a longitudinal axis of the pillow portion and the scarf 4 has a line of attachment 24 (pointed to by the arrows in FIG. 10) parallel thereto, however this need not be the case, the pocket 20 could be otherwise oriented and the scarf 4 otherwise attached. The scarf 4 is preferably stitched in place but could be held in place in any other manner, including by adhesive.

FIG. 11 shows an external pocket 21, which is attached to an outer face of the cushion. The pocket could comprise closure means, including those mentioned above in respect of the arrangement of FIGS. 9 and 10 or could comprise a pair of overlapping flaps 25, as shown, which do not include any closure means. The form of any external pocket is not particularly limited.

Figure 13:
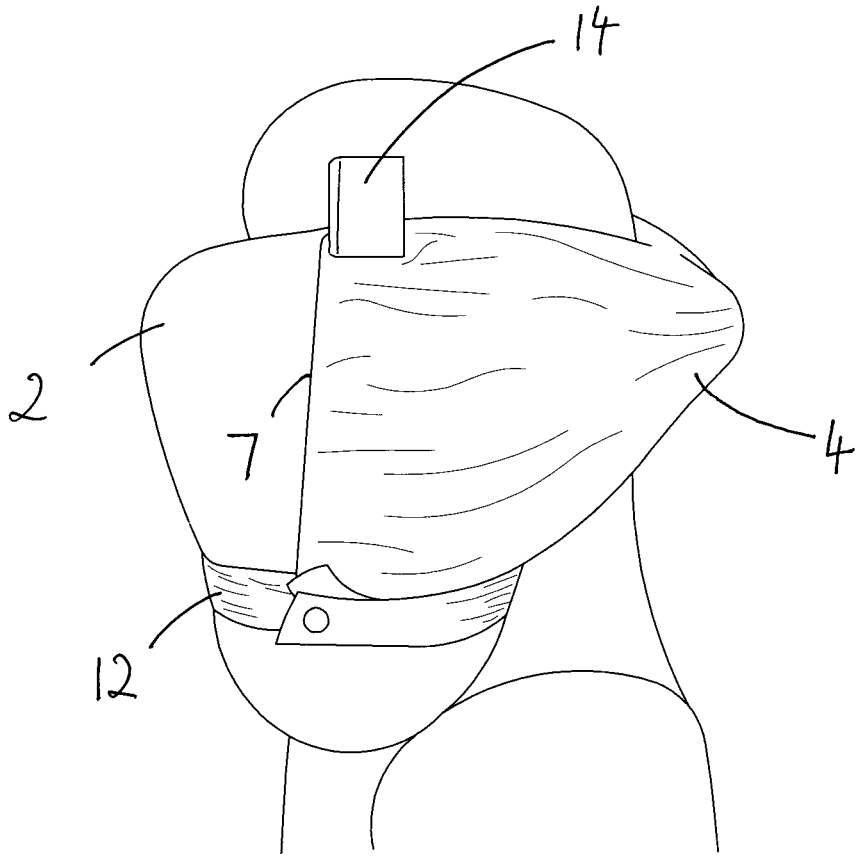
FIG. 13 shows a perspective side view of a cushion comprising the scarf of FIG. 12 in use.
Figure 14:
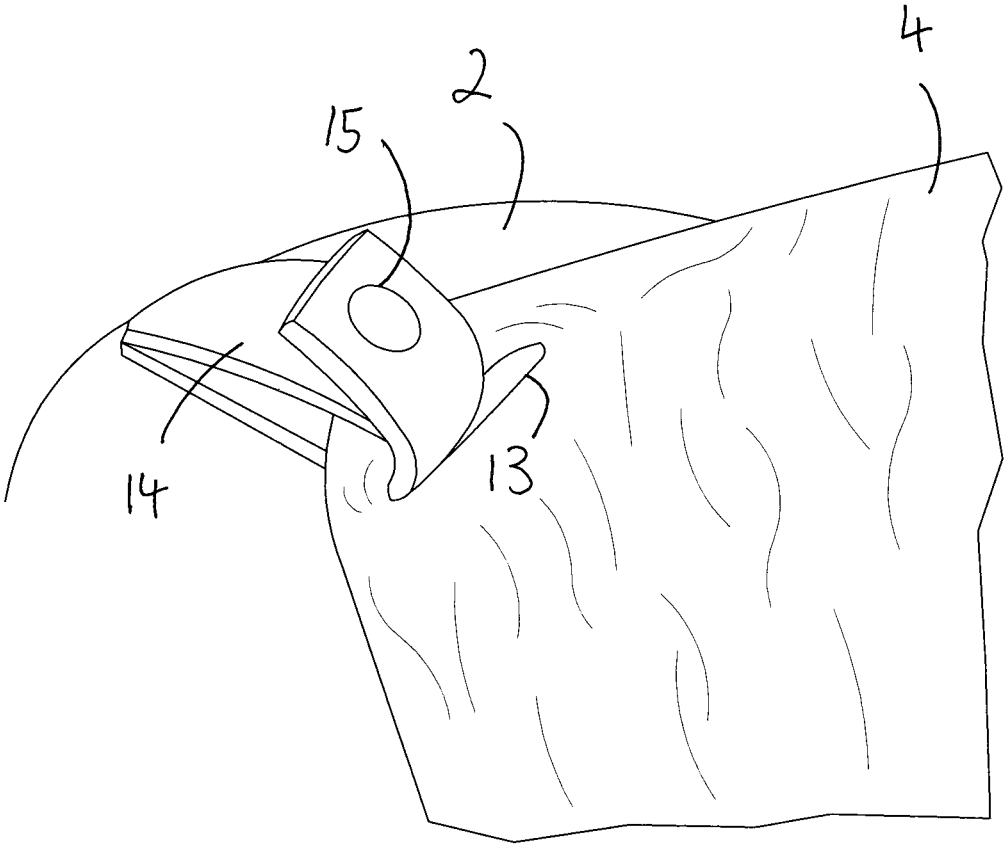
FIG. 14 shows a partial close up perspective view of the cushion of FIG. 12, showing the attachment of the scarf to the pillow portion.

FIGS. 12 to 14 show an exemplary detachable scarf 4 according to a preferred embodiment. A first loop 12 is provided at the first end portion of the scarf 4 for receiving the trunk portion 3 therethrough (as seen in FIG. 13) for attaching the scarf 4 to an end portion of the trunk portion 3 which is proximal the pillow portion 2. The scarf 4 is provided with a hole 13 at the first end portion of the scarf for attachment to a fixing means 14 on the pillow portion 2 (as seen in FIGS. 13 and 14). In the present arrangement, the fixing means 14 comprises a loop, which may be opened. It is closed by a popper 15. It should be appreciated that the fixing means 14 may comprise any alternative suitable arrangement, including, for example, a button or clip, or a loop that is otherwise arranged. It should be further appreciated that the first loop 12 of the scarf 4 could be replaced with a hole in the scarf and/or the hole 13 could be replaced with a loop. Moreover, there could be provided a fixing means adjacent the end portion of the trunk portion 3 that is proximal the pillow portion 2, including any of the exemplary fixing means above, in which case the trunk portion 3 will not be received through any loop or hole.

Regardless of the attachment means of any detachable scarf 4, the scarf is preferably provided with a spine 16 in its first end portion. The spine 16 may be formed by folding or rolling the end of the scarf 4 and fixing it to maintain the fold or roll; or may be formed by attachment of a piece of material or fabric having a greater stiffness than the remainder of the scarf 4. The spine 16 may define the line of attachment of a detachable scarf. Any of the fixed scarfs may be provided with a spine although they will most likely not include a spine.

An alternative detachable scarf 4 may comprise a suitable hook and loop fastener arrangement for engaging an outer surface of the cushion or a corresponding fastener on the outer surface of the cushion or inside a pocket 20, 21 (if provided), or any alternative fixing means such as poppers, buttons or clips. Any hook and loop fastener may extend along the spine 16, where present.

As is clear from the above described arrangements, the cushion and scarf are preferably asymmetrical when in use. The pillow is preferably symmetrical when in its rest state but asymmetrical when in use (i.e. the trunk comes forward under the chin—depicted one trunk version). The scarf is specifically designed to fit with the cushion's asymmetry when in use. The scarf connects with the asymmetrical feature of the cushion (i.e. the trunk portion). It does not connect back to the pillow portion from whence it came.

There are several advantages for the scarf to connect to the trunk portion instead of connecting back to the pillow portion:

1. The scarf stops the pillow portion from slipping away by holding it in place.

2. Pulling on the scarf pushes the pillow portion closer to the side of the head, therefore offering more support.

3. In general terms, the tighter the scarf is pulled around the user's neck the more the pillow portion is pushed into the side of the head, and therefore the greater the support. In contrast, were the scarf to loop around the neck, if the user pulled the scarf tightly around the neck (to increase the support) and then connect the scarf back to the pillow portion, it would result in the scarf being too tight around the user's neck (i.e., it would choked them). However, with the present cushion and scarf combination, according to any of the above described arrangements, the scarf connects with the trunk so the trunk therefore carries all the tension from the scarf. This means that the scarf can be pulled tightly without the scarf constricting around the user's neck.

Whilst the cushion has been described in use in a single orientation and with the scarf passing around the neck of the user, the unique arrangement of the cushion is such that it may be used in different orientations and/or with the scarf otherwise routed.

Figure 15:
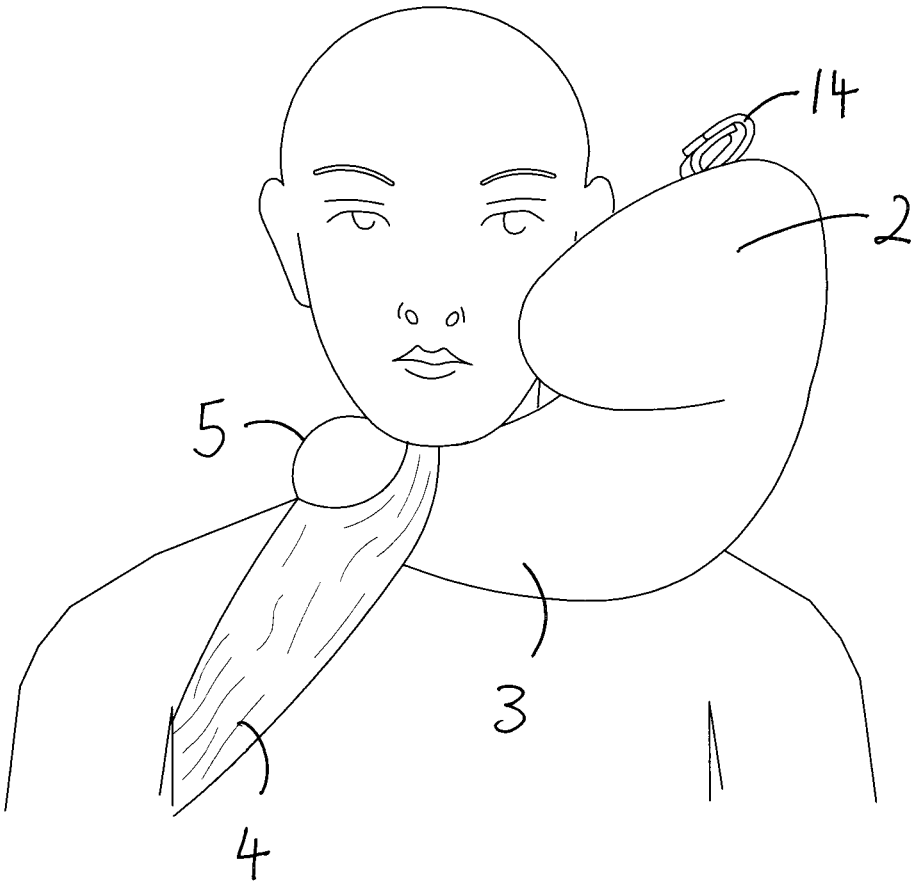
FIG. 15 shows a front elevation view similar to FIG. 5, with the cushion in use, but with the scarf extending under the armpit of the user (as opposed to around the user's neck).

FIG. 15 shows an exemplary alternative, wherein the scarf has the same orientation as discussed above but wherein the scarf is passed under the arm of the user. This can be contrasted directly with the use of the cushion shown in FIG. 5.

In an alternative orientation (not shown), the cushion can be used with the trunk portion placed in the nape of the neck (instead of under the chin). To use the pillow in this orientation, the pillow portion would be folded together substantially along its line of symmetry (to form an "apostrophe shape") and used at the side of the head. The trunk would then be placed in the nape of the neck. The scarf would still come from the rear side of the pillow portion but would wrap around the front of the user's neck and then connect with the trunk on the other side of their head.

It is to be appreciated that any of the features of the different arrangements may be taken in isolation and integrated into any other arrangement. Moreover, numerous alternative arrangements within the scope of the claims will be readily appreciated by those skilled in the art. The presently described arrangements are not to be taken as limiting the scope of the invention.

I claim:

1. A cushion including:

a pillow portion;

an elongate trunk portion; and a scarf having a first scarf side and a second scarf side opposite said first scarf side, wherein said pillow portion has a front side, a rear side opposite said front side, a first lateral side, and a second lateral side opposite said first lateral side, said pillow portion defining a support surface on said front side so as to support a head of a user, wherein the trunk portion extends away from said pillow portion and has a terminal end distal to said pillow portion, wherein said scarf is attached to said pillow portion at a first end portion of said scarf and is engageable with the trunk portion at a portion of said scarf spaced from said first end portion, and wherein said scarf is attached to the pillow portion at a point corresponding to a midpoint between said first lateral side and said second lateral side of said pillow portion, said first end portion of said scarf extending along a line of attachment between said pillow portion and the trunk portion, said line of attachment extending in a direction transverse to a direction of a longitudinal axis between said first lateral side and said second lateral side of the pillow portion so as to face said first scarf side to one side of the head of the user or said second scarf side to an opposite side of the head of the user.

2. The cushion as claimed in claim 1, wherein said scarf extends from the rear side of the pillow portion.

3. The cushion as claimed in claim 1, further comprising: an attachment means for the scarf to the trunk portion at a portion of the scarf that is spaced from the first end portion of the scarf.

4. The cushion as claimed in claim 3, wherein the attachment means comprises one or more openings in the scarf adapted to receive the trunk portion therethrough for hooking the scarf on the trunk portion.

5. The cushion as claimed in claim 4, wherein a plurality of the openings is provided in the scarf, the openings being spaced from one another along a length of the scarf.

6. The cushion as claimed in claim 1, further comprising: a pocket for stowage of the scarf.

7. The cushion as claimed in claim 1, wherein the scarf is detachable, and wherein a first loop or hole is provided at the first end portion of the scarf for receiving the trunk portion therethrough for attaching the scarf to an end portion of the trunk portion which is proximal the pillow portion.

8. The cushion as claimed in claim 7, wherein said scarf is provided with a second loop or hole at the first end portion of the scarf for attachment to a fixing means on the pillow portion.

9. The cushion as claimed in claim 1, wherein the scarf is provided with a spine in its first end portion.

10. The cushion according to claim 1, wherein the trunk portion is configured so that it is usable to contact the underside of the chin of a user whose head is being supported by the pillow portion.

11. The cushion according to claim 1, wherein the pillow portion projects from the trunk portion transversely to the elongation of the trunk portion from two opposite sides of the trunk portion.

12. The cushion according to claim 1, wherein the cushion is symmetrical, so that the pillow portion is usable to support the head of a user from either side of the head of the user.

13. The cushion according to claim 1, wherein the cushion is symmetrical about a plane bisecting the pillow portion.

* * * * *